US008857613B1

(12) United States Patent
Harris

(10) Patent No.: US 8,857,613 B1
(45) Date of Patent: Oct. 14, 2014

(54) SAMPLE DISPLAY DEVICE

(71) Applicant: Warren Harris, Short Hills, NJ (US)

(72) Inventor: Warren Harris, Short Hills, NJ (US)

( * ) Notice: Subject to any disclaimer, the term of this patent is extended or adjusted under 35 U.S.C. 154(b) by 0 days.

(21) Appl. No.: 13/928,896

(22) Filed: Jun. 27, 2013

Related U.S. Application Data

(60) Provisional application No. 61/670,972, filed on Jul. 12, 2012.

(51) Int. Cl.
*B65D 73/00* (2006.01)
*B65D 85/00* (2006.01)

(52) U.S. Cl.
CPC ..... *B65D 85/70* (2013.01)
USPC ..... 206/482; 206/730; 206/451

(58) Field of Classification Search
USPC ..... 206/482, 477, 479, 483, 472, 473, 478, 206/480, 488, 565, 730, 451, 731, 733, 734, 206/1.5; 211/40, 41.1, 41.12, 13.1, 49.1; 248/570, 444, 450, 27.3, 310, 346.04
See application file for complete search history.

(56) References Cited

U.S. PATENT DOCUMENTS

| | | | | | |
|---|---|---|---|---|---|
| 1,521,465 | A * | 12/1924 | Mills | 206/338 |
| 2,314,360 | A * | 3/1943 | Mcenery | 248/310 |
| 4,729,473 | A * | 3/1988 | Kulzer et al. | 206/477 |
| 5,131,542 | A * | 7/1992 | Stenstrom | 206/476 |
| 5,375,717 | A * | 12/1994 | Roshdy | 206/476 |
| 5,931,299 | A * | 8/1999 | Hsieh | 206/376 |
| 5,941,386 | A * | 8/1999 | Hu et al. | 206/376 |
| 6,257,409 | B1 * | 7/2001 | Lin | 206/376 |
| 6,378,700 | B1 * | 4/2002 | Tong | 206/376 |
| 6,742,653 | B2 * | 6/2004 | Kao | 206/373 |
| 6,857,527 | B2 * | 2/2005 | Hu | 211/70.6 |
| 6,955,268 | B2 * | 10/2005 | Waldron | 211/51 |
| 7,950,116 | B2 * | 5/2011 | Pylant et al. | 24/570 |
| 2003/0106867 | A1 * | 6/2003 | Caterinacci | 211/40 |
| 2009/0218302 | A1 * | 9/2009 | Winnard | 211/70.6 |

* cited by examiner

*Primary Examiner* — Bryon Gehman
*Assistant Examiner* — Rafael Ortiz
(74) *Attorney, Agent, or Firm* — Mitchell J. Mehlman, Esq.

(57) ABSTRACT

A device for safely and securely holding samples of various sizes, shapes, and weights is provided. The device includes a base and least one flexible tab disposed in proximity to at least one aperture. The base has at least one retaining member attached thereto for supporting and retaining at least one sample in a sample display position.

6 Claims, 4 Drawing Sheets

SAMPLE DISPLAY DEVICE

CROSS-REFERENCE TO RELATED APPLICATIONS

This application claims priority of U.S. Provisional Application No. 61/670,972, filed on Jul. 12, 2012, titled "SAMPLE DISPLAY DEVICE", the disclosure of which is incorporated herein by reference in its entirety.

BACKGROUND OF THE INVENTION

In the wholesale and retail manufacturing business, there is often a need to display samples of various manufactured items for a customer to view before the customer makes a purchasing decision. These samples can be almost any type of commercial product including various products used in building, construction, or home improvement. The products can be various sizes, shapes, and weights, thus making display of such items a challenge.

In some instances, it is advantageous to display multiple samples on one or more pages, sample cards, or sample display devices including sample books, folios, folders and display boards. For example, a carpet or flooring manufacturer may desire to display a dozen samples or more on a single page so that a customer can easily compare the products being displayed.

In other instances, the samples may include heavy or dense materials, such as, for example, quartz, marble or granite used in many areas of home and commercial construction. The density of granite is about 2.7 grams per cubic centimeter, or almost three times heavier than water.

Because some materials are natural products, sample sizes and weights may vary. Further, samples of natural stone or rock based product, or man-made synthetic rock type products, are often irregular in shape, size, or weight because such sample materials, are typically cut from larger pieces rather than being molded to form a precise size and shape. For illustrative purposes, a 4 inch long by 4 inch wide by 1.25 inch thick sample of granite counter top material can weigh on the order of two pounds. A two pound granite sample falling from a height of 3 or 4 feet can easily break or fracture a human toe, cause serious bodily harm or damage to property, such as a wood floor.

Conventional sample display devices are often made from low density materials such as polystyrene based foams. Such devices are structurally unable to hold multiple samples of dense materials. Known sample display devices are also inadequate in that they do not allow a user to insert a sample into a secure sample holder such that the sample cannot fall out and injure a person or cause property damage. For example, an unsupervised child may plays with sample displays while the child's parents are occupied shopping for building materials.

Thus, it is desirable that sample display devices including display folders are able to accommodate various sizes, shapes, and weights of both synthetic and natural materials in a safe and secure manner. The disclosure herein provides means for displaying a wide variety of materials in a plurality of display configurations.

Advantageously, the device is able to display heavy or irregular material samples, such as granite, quartz, or marble, in a safe secure manner in which samples can be easily removed from and placed securely into the disclosed sample display devices.

SUMMARY OF THE INVENTION

In one aspect of the invention a sample display device comprises a base. The base can include at least one aperture.

A flexible tab can be connected to the base. The flexible tab can be moved between a first position and a second position. At least one retaining member can be connected to the base for retaining a sample.

In one embodiment of this aspect, the device can include one aperture, one flexible tab, and two retaining members.

In another embodiment, device can include four apertures, four flexible tabs, and eight retaining members.

In some embodiments, the base can be a thermoplastic material.

In other embodiments, the thermoplastic material can comprise an acrylonitrile-butadiene-styrene (ABS) polymer.

In certain embodiments, the flexible tab can be integrally molded with the base.

Yet in other embodiments, at least one retaining member can integrally molded with the base.

In certain other embodiments, the flexible tab and at least one retaining member can be integrally molded with the base.

In some embodiments, the base, the tab, and at least one retaining member can be comprised of a thermoplastic material.

In other embodiments, the thermoplastic materials can comprise an acrylonitrile-butadiene-styrene (ABS) polymer.

In another aspect of the invention, a method of using a sample display device comprises grasping a sample, depressing a flexible tab connected to a base, sliding the sample into at least one retaining member connected to the base, and releasing the flexible tab, thereby retaining the sample on at least a portion of the sample display device.

In one aspect of this invention, the method can further including the steps of depressing the flexible tab, sliding the sample out of at least one retaining member, releasing the flexible tab, and removing the sample from said at least a portion of the sample display device.

In one embodiment, a user can depress the flexible tab with one of said user's fingers and grasp said sample using at least one of said user's other fingers.

In certain embodiment, a user can grasp the sample between the user's thumb, middle finger, ring finger, and pinky finger.

In one embodiment of this aspect, the device can comprise at least two retaining members.

In another aspect of the invention, a sample display apparatus comprises a base. The base can include a plurality of spaced apart aperture and a plurality of flexible tabs. The flexible tabs can be connected to the base and disposed to fit within the plurality of apertures. Each of the flexible tabs can be moved between a first sample retaining position and a second sample loading position. A plurality of retaining members can be connected to the base for retaining at least one sample.

In one embodiment of this aspect, the device includes four apertures, four flexible tabs and eight retaining members.

In another embodiment of this aspect, the base can be a thermoplastic material.

In certain other embodiments, the thermoplastic material comprises an acrylonitrile-butadiene-styrene (ABS) polymer.

In some embodiments, the plurality of flexible tabs can be tapered from a wide end proximal to said base to a narrow end distal from said base.

DETAILED DESCRIPTION

Figure 1:
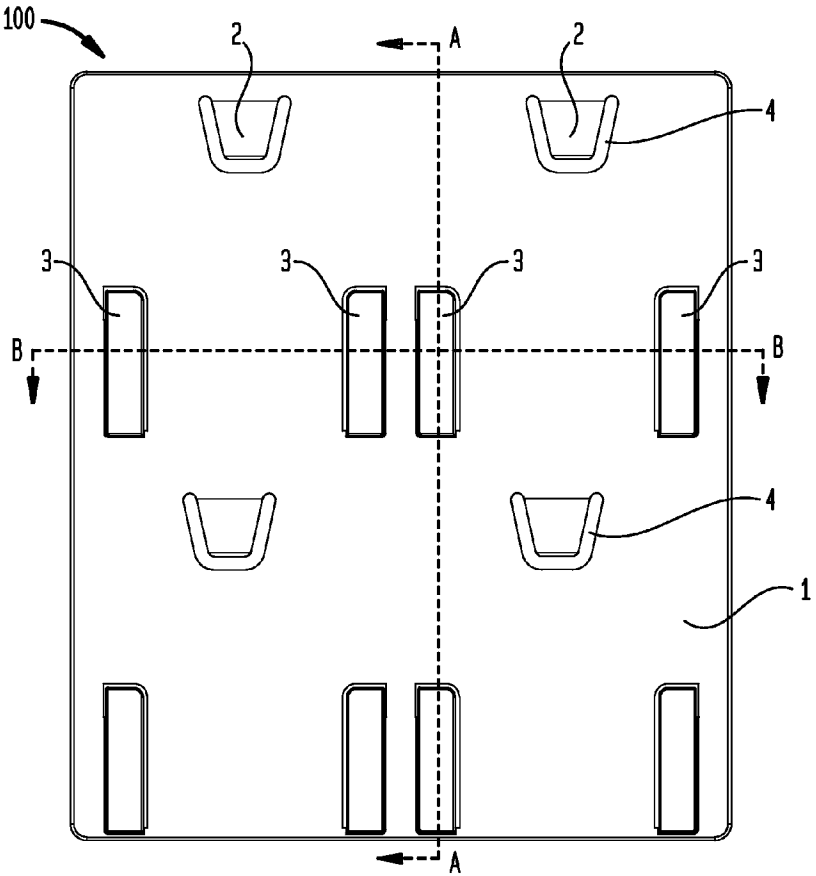
FIG. 1 depicts a plan view a sample display device in accordance with one embodiment of the present disclosure.
Figure 2:
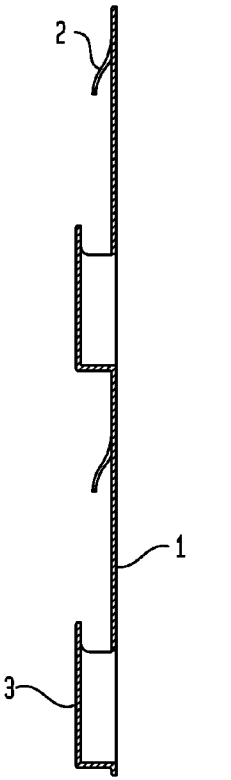
FIGS. 2 and 3 depict cross-sectional views as indicated by arrow 2 in accordance with the embodiment of FIG. 1.
Figure 3:
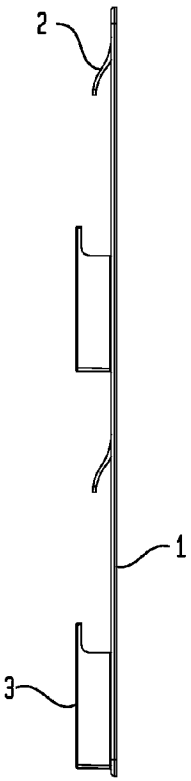
Figure 4:
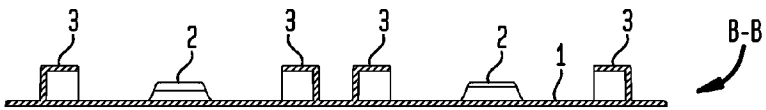
FIG. 4 depicts a cross-sectional view as indicated by arrow 3 in accordance with the embodiment of FIG. 1.
Figure 5:
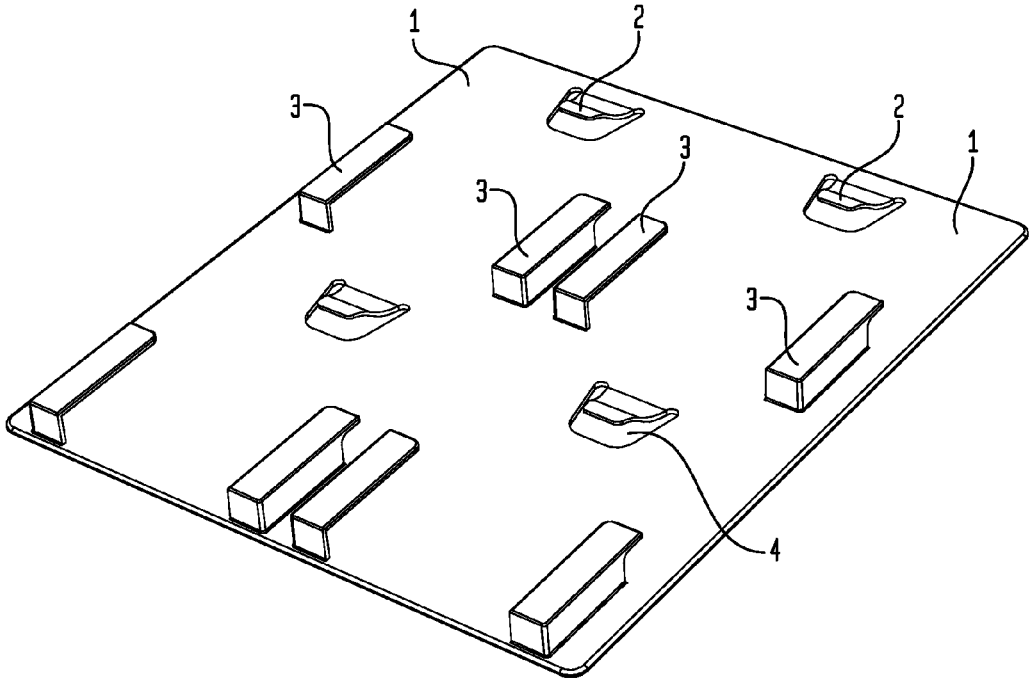
FIG. 5 depicts an isometric view of the sample display device in accordance with the embodiment of FIG. 1.
Figure 6:
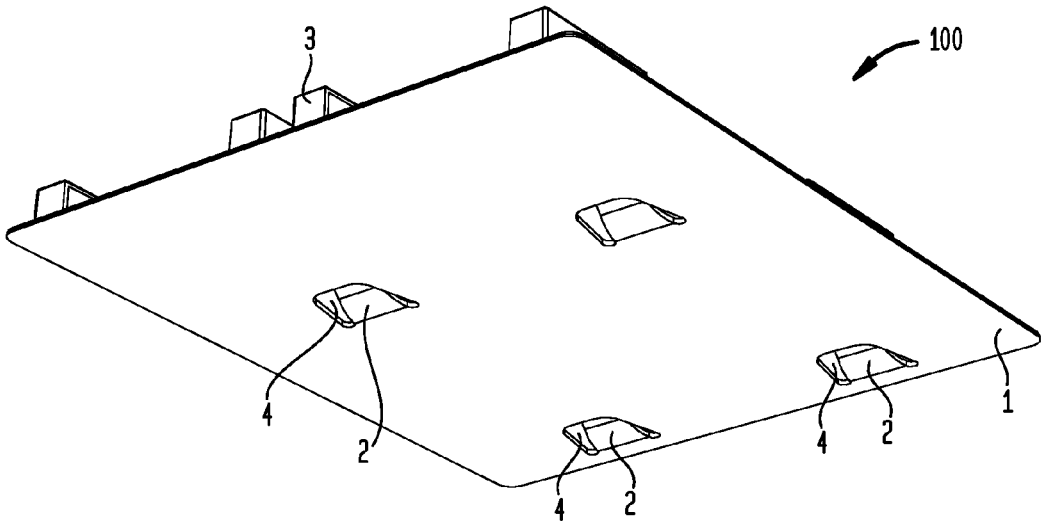
FIG. 6 depicts another isometric view of the sample display device in accordance with the embodiment of FIG. 1.

In one non-limiting embodiment of the present disclosure, as shown in FIGS. 1-6, a sample display device 100 includes base 1, flexible tabs 2, retaining members 3 and apertures 4. Base 1 can be a flat sheet of polymeric material. In some embodiments, base 1, tab 2, and retaining members 3 can be comprised of an acrylonitrile butadiene styrene (ABS) polymer.

Referring to FIGS. 1-6, base 1 includes tabs 2. The flexible tabs can be formed in base 1 as an integral part of a molded component or, for example, machined from a flat sheet of the same or a different material. In this embodiment, tabs 2 are aligned with apertures 4 in base 1, thus allowing tabs 2 to move between a first position and a second position.

Tabs 2 being flexible and can move between a sample loading position when depressed in the direction of aperture 4 and a sample retaining position when released to a nominal unstressed condition. Tabs 2 and apertures 4 can be shaped to fit a plurality of sample geometries. In an unstressed or resting condition as shown, for example, in FIG. 8, tabs 2 can exist in a sample engaging or unstressed position that is biased away from base 1 in the direction opposite arrow 7 or in a depressed or stressed position in the direction of arrow 7. Further, flexible tabs 2 can be tapered, having a wide portion proximate to said base and a narrow portion distal from said base, as shown, for example, in FIG. 1.

Figure 8:
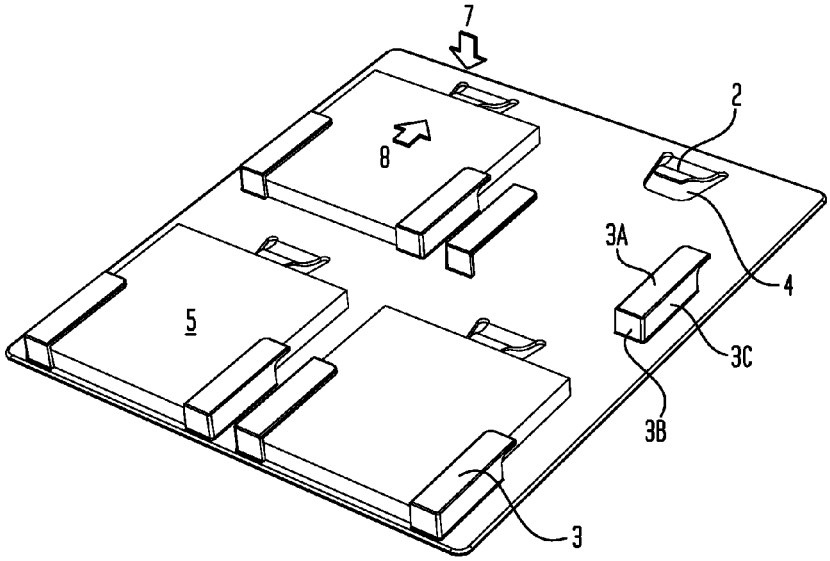
FIG. 8 depicts another isometric view of the sample display device showing three samples being retained in the device.

Base 1 can include retaining members 3. In this embodiment, each of the four sample holders includes retaining members configured as C-channels for holding a substantially rectangular sample 5. As shown in FIG. 8, retaining members 3 can comprise at least a first wall 3A, a second wall 3B and a third wall 3C for retaining a sample proximal to base 1.

In this embodiment, the retaining members can be integrally molded as part of base 1. In some embodiments, one or more retaining members can be bonded or otherwise attached to base 1. Any known means of attachment such as adhesive bonding, mechanical fasteners, or welding can be used.

Figure 7:
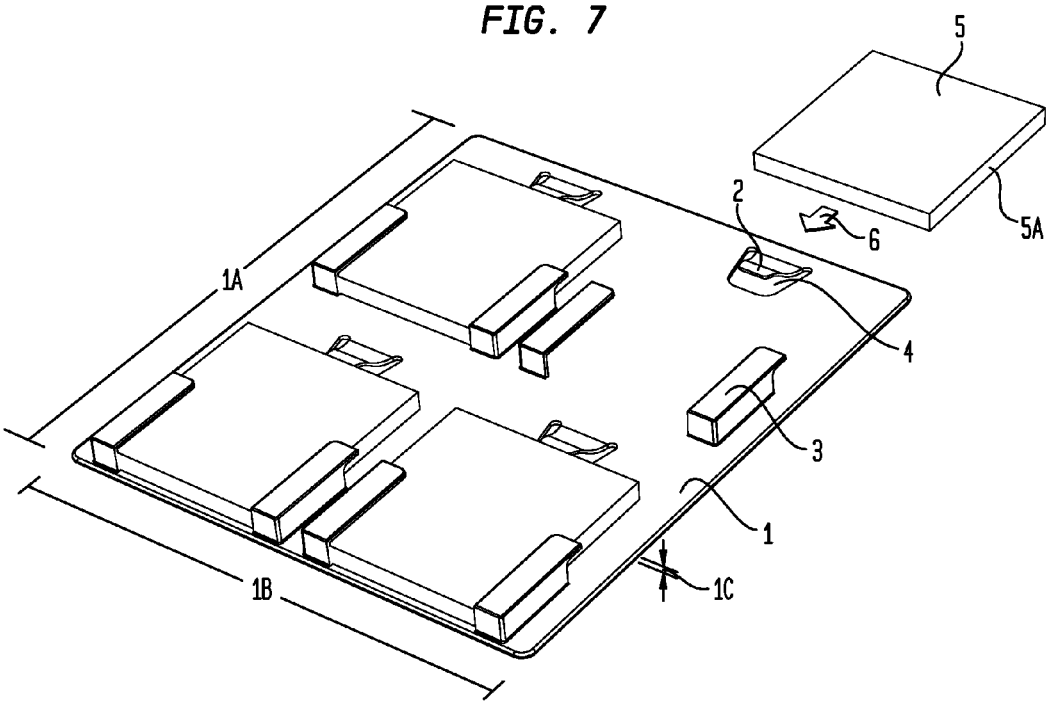
FIG. 7 depicts an isometric view of the sample display device showing three samples being retained in the device.

As shown in FIG. 7, base 1 has a length 1A, a width 1B, and a thickness 1C, each of which can be varied to meet the needs of a specific design and are not limited to any particular geometry. For example, the base can be square, rectangular, round, or any desirable flat or contoured shape.

As shown in FIGS. 7 and 8, retaining member walls 3A, 3B, and 3C can engage the edges 5A of a sample 5, which can be a tile or a wide variety of other materials, such as, for example, a sample of marble, granite, wood, engineered stone, paneling and the like.

As shown in FIGS. 7-8, in operation, a sample, such as sample 5, can slidably engage device 100. The sample 5 can be moved into a storage or display position by sliding a sample in the direction of arrow 6.

When sample 5, is loaded into the device by a user by moving a sample in the direction of arrow 6, the flexible tab 2 moves towards aperture 4. Edges 5A of sample 5 engage the walls of retaining members 3 and the base 1 thereby creating a secure holder for the sample 5. When the sample is loaded into the device and engaged by retaining members 3, tab 2 can spring back or return to an unstressed sample retaining position.

Conversely, as shown in FIG. 8, a user can depress tab 2 in the direction of arrow 7 to slidably remove sample 5 from the device 100 by moving the sample in the direction of arrow 8. After the sample is removed, tab can return from a sample loading or engaging position disposed proximate to aperture 4 to a sample retaining position disposed away from aperture 4.

In this particular embodiment, two retaining members 3 and one tab 2 are used to hold each of four samples, that is, this embodiment of the device includes 8 retaining members and 4 tabs. Other embodiments can include one or more tabs and one or more retaining members to hold any number of desirable samples. It will be well known to one of ordinary skill in the art of structural design or engineering to modify the invention to a plurality of tab configurations, retaining member configurations, and device configurations.

For example, a different embodiment of the device 100 may include three retaining members and two tabs per sample to retain one or a plurality of samples on a base. Likewise in other embodiments, a single retaining member and at least one tab can be used to retain one or more samples on a base. The shape and size of the retaining member or retaining structure can be modified depending on the size, shape, and mass of the sample to be retained.

Figure 9:
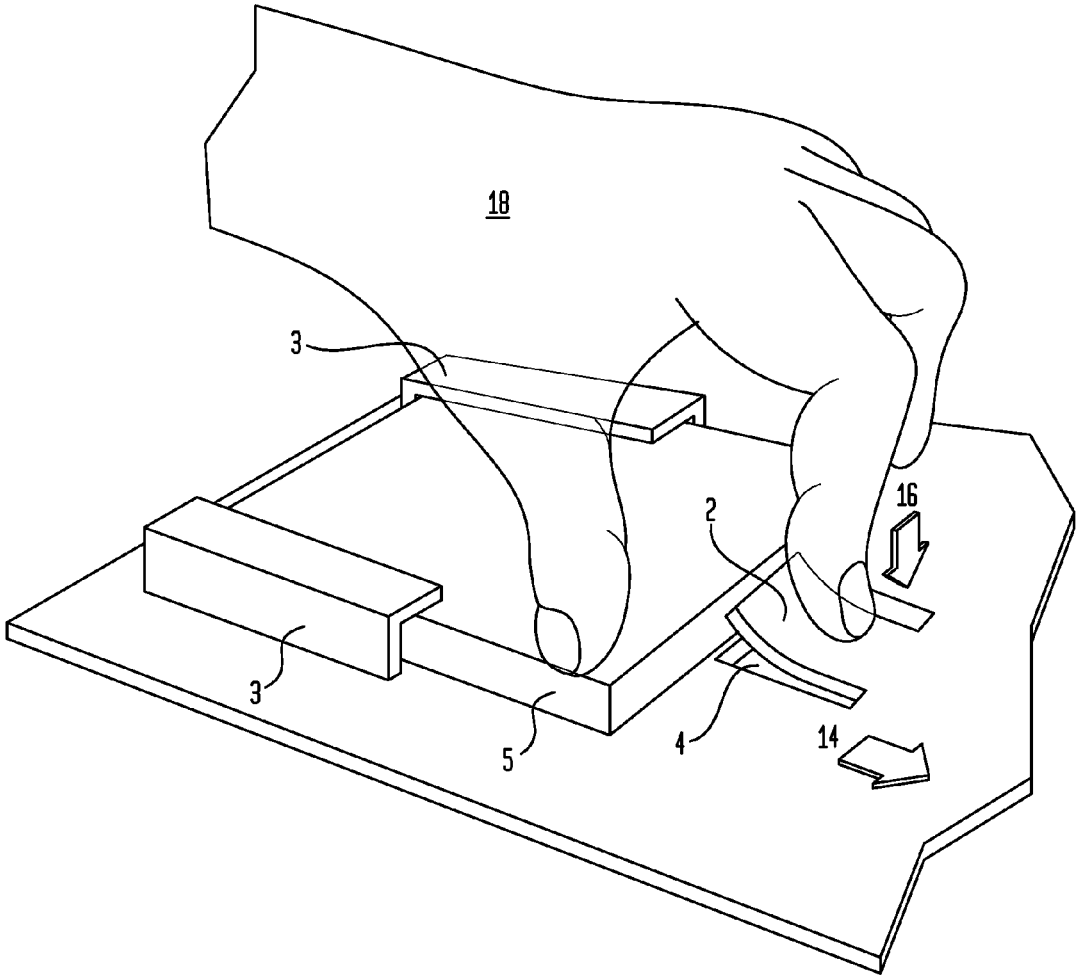
FIG. 9 depicts a method for using a sample display device.

As shown in FIG. 9, loading and unloading of a sample can be accomplished using one hand 18. First, a user can depress and hold tab 2 using, for example, an index finger and pressing tab 2 in the direction of arrow 16, such that tab 2 is substantially flush or below aperture 4. Next, the sample 5 can be grasped with a user's fingers, such as a thumb, middle finger ring finger or pinky finger. The user can then move sample 5 in the direction of arrow 14 to slide the sample 5 away from retaining members 3 to unload a sample or in the opposite direction to load a sample. When the user removes the sample 5 or loads the sample 5, flexible tab 2 springs back and returns to a sample retaining position.

Other embodiments of the present disclosure can include a plurality of devices 100 bound within a sample display folder or folio, or attached to a display board.

The sample display device as disclosed herein can be fabricated using well known materials and processes. For example, the device may be injection molded, compression molded, resin transfer molded, or machined from a large prefabricated sheet made by, for example, extrusion.

In some embodiments, the sample device comprises engineering polymers. In some embodiments, the device is injection molded from an acrylonitrile butadiene styrene (ABS) based polymer. Other thermoplastic or thermoset resins or combinations thereof can be used to produce the devices disclosed herein.

Materials and manufacturing processes, including snap fit assembly, CNC machining, or adhesive bonding for manufacturing the device, and molding methods and assembly techniques as discussed above will be well known to those of ordinary skill in the art of packaging or polymeric materials manufacturing.

It is to be understood that the geometry of the sample display device is not limited to the specific geometries disclosed herein. Any geometry that allows a user to remove and replace at least one sample, thus creating a structurally sound and secure sample display device for one or more samples is contemplated to be within the scope of the present invention.

In its simplest form, the device can have as few as one sample holder, whereby increasing the number of holders, can increase the efficiency of the device and will depend on user needs and requirements and the type, shape and size of material to be displayed. For example, the device can be used for securely and removeably holding 4, 20, 50, or 100 samples or more depending on the shape, size, and weight of the samples.

For example, the disclose device can be used to hold large heavy granite blocks or tiny lightweight computer components. As discussed above, the display device may be incorporated in a folder or folio for display of multiple samples.

In some embodiments of the present disclosure, one or more bases can be bound in a book like configuration such that a binder holds one or more sample display devices. Likewise, the sample display devices can be mounted to a wall or any other structure which is robust enough to support the sample holder when loaded with sample. Any known conventional means for binding or mounting the device can be used.

Although the invention herein has been described with reference to particular embodiments, it is to be understood that these embodiments are merely illustrative embodiments and that other arrangements may be devised without departing from the spirit and scope of the present invention as defined by the disclosure herein.

What is claimed is:

1. A sample display device comprising:

(a) a rigid polymer base, said rigid base including at least one aperture through said rigid base, wherein said base comprises a non-foldable structure for display of samples;

(b) at least one flexible tab, said at least one flexible tab being disposed within said aperture, said at least one flexible tab being capable of flexing to be substantially co-planar with said base, said at least one flexible tab being integral with said at least one flexible base, wherein said at least one flexible tab has a first end proximate to said base and a second end distal from said base, said at least one flexible tab being tapered to have a progressively decreasing width from said first end to said second end, thereby allowing said at least one flexible tab to be moved flexibly between a first loading position wherein said at least one flexible tab is substantially co-planar with said base and substantially fills said aperture and a second retaining position wherein said at least one flexible tab is curved in a direction away from said aperture and substantially parallel to said base; and (c) at least one sample retaining member, said at least one sample retaining member including a first wall being substantially parallel to said base, a second wall being substantially perpendicular to said first wall, and a third wall being substantially perpendicular to said first wall and said second wall, wherein said second wall is joined to said first wall and said third wall thereby forming at least one C-channel for retaining and displaying at least one sample, said at least one retaining member being connected to said rigid base for retaining the at least one sample therein, wherein said at least one sample is retained within said retaining member by said at least one flexible tab thereby allowing a user to remove the at least one sample from said device by depressing said at least one flexible tab and sliding the at least one sample out of said at least one sample retaining member.

2. The sample display device of claim 1, wherein said device includes one aperture through said rigid base, one flexible tab, and two retaining members.

3. The sample display device of claim 1, wherein said device includes four apertures through said rigid base, four flexible tabs, and eight retaining members.

4. The sample display device of claim 1, wherein said retaining member is integral with said rigid base.

5. A sample display apparatus comprising:

(a) a rigid polymer base, said rigid base including a plurality of spaced apart apertures therethrough, wherein said base comprises a non-foldable structure for displaying samples;

(b) a plurality of flexible tabs, said flexible tabs being connected to said rigid base and disposed proximate to said plurality of apertures and extending outward of said base, wherein each of said flexible tabs has a first end proximate to said base and a second end distal from said base, said tabs being tapered to have a progressively decreasing width from said first end to said second end and can be moved between a first sample retaining position substantially outside of said apertures and a second loading position substantially coplanar with said base and within said apertures; and (c) a plurality of C-shaped retaining members, said retaining members being connected to said base, said retaining members each including a first wall being substantially parallel to said base, a second wall being substantially perpendicular to said first wall, and a third wall being substantially perpendicular to said first wall and said second wall, wherein said second walls are joined to said first walls and said third walls thereby forming a plurality of C-channels for retaining and displaying a plurality of samples.

6. The sample display device of claim 5, wherein said device includes four apertures through said rigid base, four flexible tabs, and eight retaining members.

* * * * *